US006598417B1

(12) United States Patent
Wilkes

(10) Patent No.: US 6,598,417 B1
(45) Date of Patent: Jul. 29, 2003

(54) MULTI-CHANNEL LOCAL BEVERAGE COOLER

(76) Inventor: Oscar Wilkes, 2524 Ellentown Rd., La Jolla, CA (US) 92037

( * ) Notice: Subject to any disclaimer, the term of this patent is extended or adjusted under 35 U.S.C. 154(b) by 0 days.

(21) Appl. No.: 09/745,831

(22) Filed: Dec. 22, 2000

(51) Int. Cl.[7] ..... B67D 5/62
(52) U.S. Cl. ..... 62/390; 62/393; 222/146.6
(58) Field of Search ..... 62/390, 393, 396, 62/99, 389; 222/146.6; 165/164, 157–163

(56) References Cited

U.S. PATENT DOCUMENTS

| | | | | |
|---|---|---|---|---|
| 2,162,649 A | | 6/1939 | Spitz | |
| 2,199,503 A | | 5/1940 | Martin | |
| 2,342,299 A | | 2/1944 | Peet | |
| 2,646,667 A | | 7/1953 | Kromer | |
| 4,011,896 A | * | 3/1977 | Nilon et al. | |
| 4,014,295 A | * | 3/1977 | Lions | 165/160 X |
| 4,094,445 A | * | 6/1978 | Bevan | |
| 4,676,400 A | | 6/1987 | Lamont et al. | |
| 4,842,053 A | * | 6/1989 | Yatsuhashi et al. | 165/104.14 |
| 4,924,676 A | | 5/1990 | Maier-Laxhhuber et al. | |
| 4,949,552 A | | 8/1990 | Adams | |
| 5,079,927 A | * | 1/1992 | Radino et al. | 62/389 X |
| 5,564,602 A | | 10/1996 | Cleland et al. | |
| 5,743,107 A | * | 4/1998 | Kyees | 62/390 |
| 5,823,251 A | * | 10/1998 | Romero | 165/158 |

OTHER PUBLICATIONS

Incriopera et al.; Introduction to Heat Transfer, 1996; John Wiley & Sons; P544–545.*

* cited by examiner

*Primary Examiner*—Chen Wen Jiang
(74) *Attorney, Agent, or Firm*—Thomas J. Tighe, Esq.

(57) ABSTRACT

A cooler for cooling a plurality of brands of liquid beverages for delivery at taps for dispensing to customers at a desired chilled temperature. The cooler has a heat exchanger with a shell having channels passing through it, each communicating with a keg containing a beverage and a dispensing tap. Chilled coolant, controlled by the heat exchanger flows through the shell to cool the beverage flowing through the channels to the desired temperature. The temperature of the coolant is controlled by a temperature controller to maintain a narrow desired temperature range, just above the freezing temperature. The cooler is capable of cooling each of the channels without having to be installed in a walk-in cooler, allowing its installation proximate the serving taps. Also, the kegs containing the various brands of beer which are connected to the heat exchanger do not have to be kept in a walk-in cooler. 30° F. to 34° F. range.

17 Claims, 3 Drawing Sheets

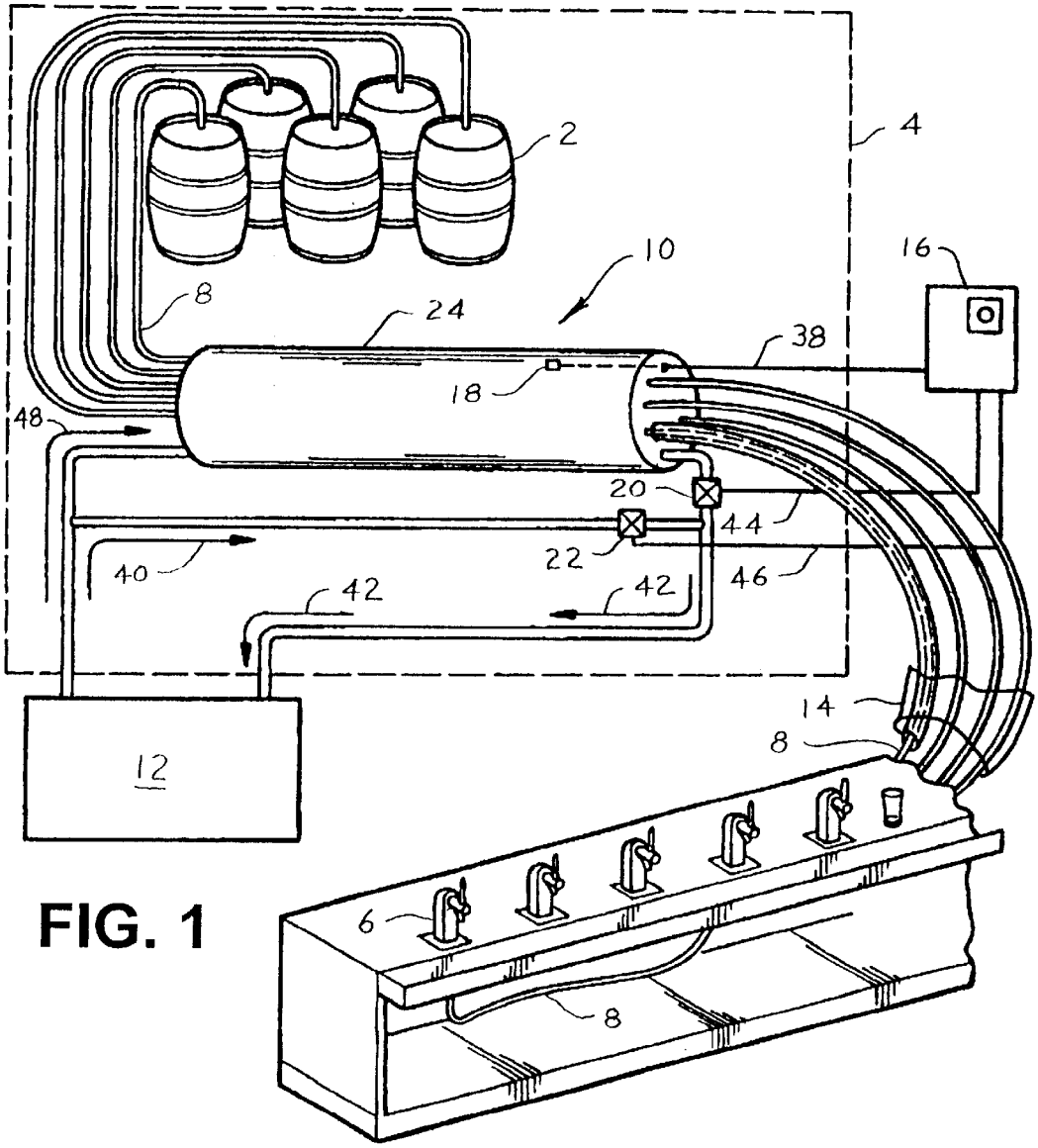
FIG. 1
FIG. 2
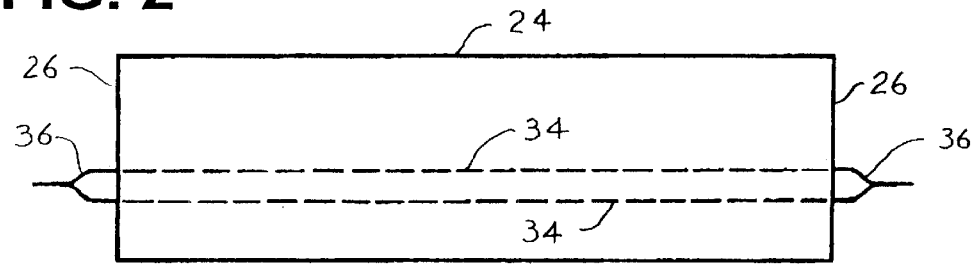

MULTI-CHANNEL LOCAL BEVERAGE COOLER

BACKGROUND OF THE INVENTION

This invention relates in general to an apparatus for chilling a beverage piped from a remote source, which apparatus can be local to a dispenser of the beverage, and more particularly to such an apparatus which can separately chill a plurality of different beverages.

While this invention can be used to cool a variety of liquids, it is particularly useful for chilling and dispensing a plurality of carbonated beverages, such as beer. Beer generally refers to fermented alcoholic malt beverages, generally flavored with hops, and commonly referred to as beer, stout and ale. As used herein, beer also refers to versions of such products which may contain little or no alcohol.

While beer is commonly served warm in some parts of the world, such as Great Britain, Americans, particularly North Americans, prefer their beer served chilled. Americans also prefer a minimum amount of foam or froth with their beer. Because beer is carbonated, it naturally foams when released from a pressurized container, but such foaming is minimized if the beer is served close to its freezing temperature of approximately 29° F. While this is not a problem for bottled or canned beer which can be kept chilled in a refrigerator near its point of sale, draft beer is conventionally contained in large kegs which generally must be stored remote from their dispensing taps. Beer from a remote keg is piped to a tap by tubing which is commonly referred to as a beer "line." Beer in a keg is pressurized to propel the beer through its line to the tap. To minimize foaming as beer is poured from a tap, the keg feeding the tap is typically stored in a large, walk-in refrigerator or cooler to reduce the temperature of the beer.

This invention addresses problems which are inherent in the use of such large kegs. Depending upon the size of the establishment, a walk-in cooler can be a considerable distance, as much as several hundred feet, from the establishment's dispensing taps. This means that the beer must traverse long unrefrigerated lines from the kegs to the taps, and so the beer is warmed along the way, especially if the beer sits in the lines any appreciable time in between pours. Also, because of cost factors, other customer consumables are typically stored in the walk-in coolers along with the kegs, consumables which cannot be stored at near 29° F., and so the coolers must be restricted to temperatures no lower than approximately 38° F. which is much higher than desirable for minimizing foam and maximizing flavor.

Conventionally these problems are addressed by running a line containing a coolant, such as Glycol, and its return line juxtaposed with the beer lines in an insulated sleeve. The proximity of the coolant lines to the beer lines draws heat from the beer lines. However, the coolant lines and the beer lines are typically flexible nylon or plastic tubing which do not conduct heat very well, and the heat transfer interfaces, i.e., points of contact between the beer lines and the coolant lines are not reliable or consistent. Depending on bends and twists, there can be very little actual contact between the coolant lines and beer lines. In other words, for much of the distance travelled, some of the beer lines often may not even touch a coolant line. Even at best, a beer line and a coolant line can only make tangential contact since they are both circular in cross-section. Thus the results have not been satisfactory. Using these conventional systems, the temperature of beer flowing from a tap typically is not much lower than the ambient temperature (higher than desirable as explained above) in the walk-in cooler in which the kegs are stored.

This invention solves the problem of delivering a pressurized beverage, e.g. keg beer, to a distant tap at a temperature higher than desired. Additionally it can simultaneously cool a plurality of beverage lines, satisfactorily chilling the beverage in each line for dispensing to customers. Also it can be selectively configurable according to the number of beverage lines needing to be chilled.

Other advantages and attributes of this invention will be readily discernable upon a reading of the text hereinafter.

SUMMARY OF THE INVENTION

An object of this invention is to provide an apparatus for locally chilling to a desired temperature a plurality of beverages being piped from a remote location.

Another object of this invention is to provide such an apparatus for chilling a plurality of beverages in transit in respective beverage lines.

Another object of this invention is to provide such an apparatus which can effectively operate outside, as well as inside, a walk-in cooler.

Another object of this invention is to provide an apparatus for locally chilling to a desired temperature a plurality of beers being piped from kegs at a remote location.

Another object of this invention is to provide an apparatus for chilling locally to respective taps a plurality of beers being piped from kegs at a remote location.

Another object of this invention is to provide a chilling apparatus as described above including a shell containing a coolant through which beverage lines traverse.

Another object of this invention is to provide an apparatus as described in the preceding paragraph in which at least one line makes a plurality of passes through the coolant in the shell.

Another object of this invention is to provide an apparatus as described above in which at least one line includes multiple branches through the coolant.

Another object of this invention is to provide an apparatus as described above which is small enough to be located proximate the dispensing taps.

Another object of this invention is to provide an apparatus as described above designed to easily affect repairs to beverage lines outside the shell.

Another object of this invention is to provide an apparatus as described above designed to easily reroute beverage lines therethrough.

Another object of this invention is to provide an apparatus as described above which is thermostatically controlled.

These objects, and other objects expressed or implied in this document, are accomplished by an apparatus which includes a heat exchanger through which a plurality of channels, communicating with respective beverage lines, extend for chilling beverages passing through the channels. In a preferred embodiment the heat exchanger includes a shell defining a chamber containing a coolant, preferably propylene glycol. The channels extend through the chamber and are bathed in the coolant, the walls of the channels being efficient heat conductors conduct heat from the beer to the coolant bath. Preferably each beverage line communicates with a channel that includes multiple serial or multiple parallel passes through the chamber. A significant advantage is that the apparatus need not be installed in a walk-in cooler, but rather it is preferably disposed local, or wherever convenient, to the beverage dispensing taps. Included are thermostat controls to regulate the flow of coolant to quickly cool the beer in the channels running through the heat exchanger to a temperature range of within one degree of the desired temperature of approximately 30° F., minimizing the amount of foam when the beer is dispensed. Preferably the beverage lines between the apparatus and the taps are insulated to impede heat absorption. Preferably the flow of coolant through the chamber is controlled by two separate valves or by a single three-way valve operated by the thermostat.

BRIEF DESCRIPTION OF THE DRAWINGS

FIG. 1 is a pictorial view of one embodiment of this invention.

FIG. 2 is a schematic drawing of a beverage line communicating with a channel having multiple serial passes through the shell of a heat exchange chamber of FIG. 1.

DESCRIPTION OF THE PREFERRED EMBODIMENT

Figure 3:
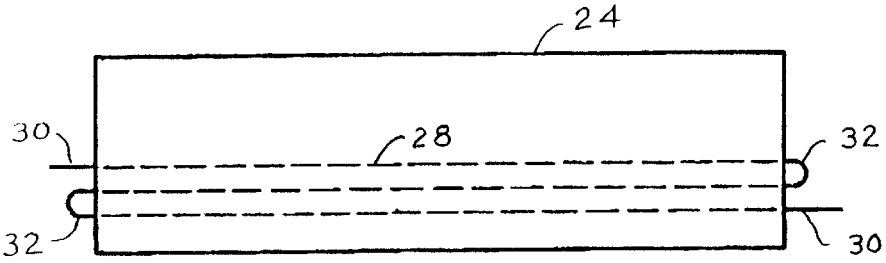
FIG. 3 is a schematic drawing of a beverage line communicating with a split channel, i.e. a channel having multiple parallel passes through the heat exchange chamber.

Establishments that serve draft beer typically have a walk-in cooler for storing kegs of different brands of beer served. The cooler keeps the beer in the kegs at a temperature less than normal room temperature. However, because of operating costs and the need to store other consumables in the cooler, coolers are rarely maintained at less than approximately 38° F. This leaves a large temperature gap between the temperature in the walk-in cooler and the most desirable serving temperature for beer, i.e., approximately 30° F. Beer chilled to this temperature, just above its freezing point of approximately 29° F., produces the minimum amount of foam when dispensed and customers also prefer this colder temperature. This invention can chill a plurality of beer lines to the preferred serving temperature of approximately 30° F. while still allowing the kegs to be stored in a warmer walk-in cooler, or no cooler at all.

Referring to FIG. 1, illustrated are a plurality of beer kegs 2 of various brands of beer stored in a walk-in cooler 4, designated by a dashed outline. The walk-in cooler is optional since this invention can be used to chill the beer from kegs whether or not they are stored in a walk-in cooler. However, if a walk-in cooler is available, the kegs can be stored therein to precool the beer prior to being further chilled to the desired temperature by this invention. The kegs ultimately communicate pressurized beer to a plurality of corresponding dispensing taps 6 located in a beer-serving establishment. As illustrated the taps are remote from the walk-in cooler, but they need not be for this invention to be useful. Additional kegs of beer (not shown) may be stored in the walk-in cooler for future use. The kegs have been tapped and each is connected by a beer line 8 to the ingress port of a corresponding flow-through channel inside a coolant chamber of a heat exchanger, generally designated 10. The beer flows through the channels in the heat exchanger where it is chilled by a liquid coolant from a chiller 12. As used herein a "chiller" is a conventional device which continuously draws heat from the coolant to keep it at a suitable temperature, typically between 23° F. to 28° F., a coolant temperature being suitable if it is low enough, in light of known heat transfer characteristics of the coolant and channels and the characteristics of the incoming beer (temperature, volumetric rate, heat capacity), to chill the beer enough so that as it is flowing from the taps, the beer is at or very near a desired low-foam drinking temperature. The chiller is preferably located outside the walk-in cooler so the heat absorbed by the coolant can be dissipated without warming up the walk-in cooler.

Referring again to FIG. 1, additional beer lines 8 are connected to respective egress ports of the heat exchanger's internal flow-through channels to communicate beer to the dispensing taps 6, completing each keg's flow path to a tap. Thus there is a separate path from each keg, through the heat exchanger, to a corresponding tap. The beer lines between the heat exchanger and the taps are also preferably enclosed in an insulation sleeve 14 to prevent the chilled beer from absorbing heat as it travels to the taps. A temperature controller 16 regulates the temperature of the coolant in the heat exchanger. It senses the coolant's temperature by means of a temperature sensor 18 and operates normally-closed, preferably solenoid-operated valve 20 and normally-open, preferably solenoid-operated valve 22 to control the flow of coolant to the heat exchanger. The operation of the temperature controller to control the flow of coolant through the heat exchanger will be described in more detail below.

For each embodiment described herein, the kegs are preferably pressurized by gas lines (not shown) which are typically connected to tapping devices which open the kegs to their respective beer lines. The gas is sourced typically by a compressor, a cylinder of carbon dioxide or a cylinder of nitrogen (none shown). The pressurized gas serves to force the beer through the beer lines to the dispensing taps 6. The beer lines are preferably nylon tubing commonly used for such purpose and preferably ⅜ inch diameter.

Referring to FIGS. 1 and 3, an alternate embodiment of the heat exchanger has a generally cylindrical shell 24, closed at the ends by end surfaces 26. The shell is of rigid construction, capable of containing several gallons of coolant, preferably a food grade antifreeze such as propylene glycol. The shell can be constructed from sections of large diameter pipe, preferably 3.5–6.0 inches in diameter, depending on the number of separate channels and loop-backs (as explained below) which pass through the shell. The end walls of the shell each define a plurality of holes through which opposite ends of the heat exchanger's internal beer channels 28 extend to form nipples 30. Each nipple allows a beer line 8 to be affixed thereto, and a seal around each nipple prevents leakage of the coolant. Since one pint is a common increment of beer drawn from a tap, preferably each beer channel has a volume of at least one pint, and so at any given time the channel contains at least one pint of beer being chilled within the heat exchanger, and ready for serving. (It should be understood that embodiments of this invention can be adapted to other preferred increments of draw.) The beer channels 28 are preferably ⅜" diameter stainless steel tubing which allows heat from the beer to be rapidly conducted through the channel's walls to the surrounding coolant. For a standard ⅜" diameter channel, having an inside diameter of 0.277", the channel must be about 40 feet long to contain one pint. However, to reduce the length of the shell, the beer channels of this embodiment serially traverse the coolant chamber multiple times, i.e.

passing back and forth through the length of the shell several times. As illustrated in FIG. 3, each return pass of a channel has an external 180° rounded bend 32, and each such bend in the channel allows another pass through the shell. This gives the beer, flowing through the channels, a longer period of time to be chilled by the surrounding coolant in the shell. The bends are preferably disposed outside the ends of the shell so that bends can be added or subtracted from a given channel as desired without breaching the shell. Preferably the bends mate with the nipples 30 in the same fashion as the beer lines 8, but they can also be affixed permanently to ends of adjacent channel segments. This makes it easier to install the beer lines and to make changes to the lines, if needed. As an example, with a channel looped back five times (six passes through the shell and thus the coolant bath in the shell), a pint of beer can be held in the channel inside a shell of approximately 6.67 feet. Since beer is sometimes served in quantities larger than one pint and since beer entering the heat exchanger will be cooled as it passes through the heat exchanger, the length of the shell is preferably between 6 to 8 feet. This allows the heat exchanger to be installed in a convenient location near the dispensing taps 6. This is a major advantage because its small size gives great flexibility in where it is located along the path between keg and tap.

Referring to FIGS. 1 and 2, an alternate embodiment of the invention includes a heat exchanger having a shell 24 through which two or more reduced diameter beer channels 34 communicate with a beer line 8. As illustrated, incoming and outgoing manifolds 36 are affixed to opposite nipples of two adjacent channels 34 extending through holes defined in the opposite end walls 26 of the shell. The manifolds preferably split ⅜" diameter beer lines 8 into two ¼" diameter beer channels 34. Each pair of the ¼" channels has approximately the same volume per unit of length as each of the ⅜" channels, but approximately one-third more surface area. This means a,that the beer flowing in the channels is chilled in less time than if it was flowing through a single ⅜" channel. This permits the shell to be much shorter while achieving the same or even greater heat transfer from the beer as compared to the FIG. 1 embodiment.

Referring again to FIG. 1, in operation the temperature of the coolant in the shell 24 will be greater than the desired 30° F. temperature when the system is first started. The temperature sensor 18 will detect the high coolant temperature coolant and electrically communicate the temperature to the temperature controller 16 by sensor line 38. The temperature controller will then compare the sensed temperature with preset upper and lower limits preselected and entered by an operator.

Another advantage of this invention concerns the narrow, temperature range at which it can be operated. Typically the upper and lower limit temperatures for walk-in coolers are necessarily set to several degrees above and below the desired temperature, 5–6° F. above and below, for example. This is necessary to prevent the motor of the walk-in cooler's refrigeration unit from burning out due to frequent cycling on and off which can happen if the temperature range is set too narrow. This is a wide range, typically allowing the temperature to vary from between approximately 32° F. to approximately 44° F., not good for beer. However, for this invention the desired coolant temperature range can be set much tighter, typically a 2° F. range, allowing the temperature to vary only 1° F. above or below the desired temperature of 30° F. without the danger of the chiller's motor burning out due to frequent cycling. This is because the liquid glycol coolant can be cooled more efficiently than the air in a walk-in-cooler, and there are fewer heat losses in the compact heat exchanger of this invention as compared to a large walk-in-cooler.

Referring again to FIG. 1, when not energized by the temperature controller, valves 20 and 22 are in their normal positions, with valve 20 closed and valve 22 open, allowing coolant from the chiller 12 to flow through valve 22 in the direction of arrows 40 and 42, bypassing the heat exchanger 10. When the temperature controller detects a coolant temperature in the shell above the preset upper limit, preferably approximately 31° F., it signals valve 20 to open and valve 22 to close. This is done by communicating operating signals, electrically or pneumatically, via control lines 44 and 46 to valves 20 and 22 respectively. Opening valve 20 and closing by-pass valve 22 directs coolant to be pumped from the chiller 12, in the direction of arrow 48, through the shell 24 and through valve 20, in the direction of arrows 42, back to the chiller. The chiller refrigerates the coolant to a desired range, typically between approximately 23° F. and 28° F. As previously explained the coolant circulates and flows around the channels in the shell, chilling the beer within the channels. As the temperature of the coolant in the shell is reduced by the incoming refrigerated coolant, it will be sensed by the temperature sensor 18. The temperature controller 16 monitors the temperature sensor by sensor line 38, and when the temperature of the coolant reaches the lower limit of the range set in the controller, preferably approximately 29° F., the controller will cause the coolant circulation to bypass the heat exchanger. It does this by signaling valve 20 to close, via line 44, and signaling valve 22 to open, via line 46. This blocks the coolant circulation path through the shell and opens the bypass path, indicated by arrow 40, i.e., through open valve 22 and returning to the chiller 12, as shown by arrows 42. As the coolant absorbs heat, either from outside the shell or from beer flowing through the channels in the shell, its temperature will rise. This rise in temperature will be detected by the sensor 18 causing the temperature controller 16 to again energize valves 20 and 22 to allow the chilled coolant to flow through the shell. This keeps the temperature of the coolant in the shell at, or very near, the preferred 30° F. temperature. The chilled beer flowing through the channels in the heat exchanger 10 and communicating with beer lines 8 continues on to the connected taps 6 for dispensing to a customer. The beer lines between the heat exchanger and the taps are preferably enclosed by an insulation sleeve 14 to reduce the absorption of heat by the beer in the beer lines. The beer lines between the heat exchanger and the serving counter can be insulated individually or together in a single sleeve. However, at the serving counter, the beer lines are preferably also insulated individually to their connected taps 6.

Figure 4:
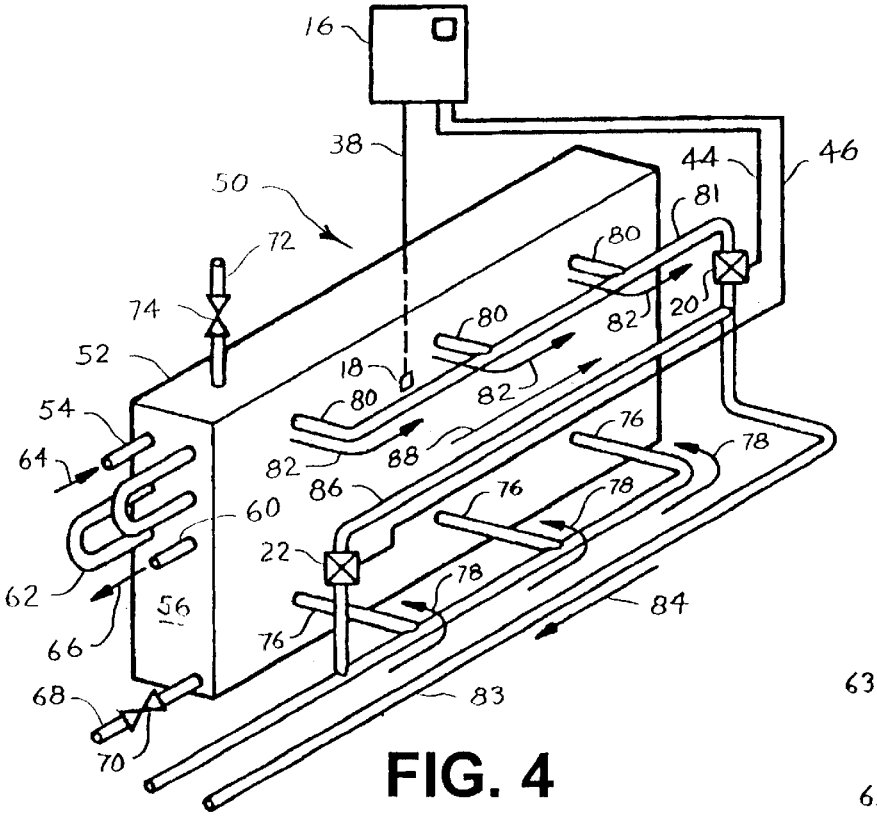
FIG. 4 is a pictorial view of a second embodiment of this invention.
Figure 5:
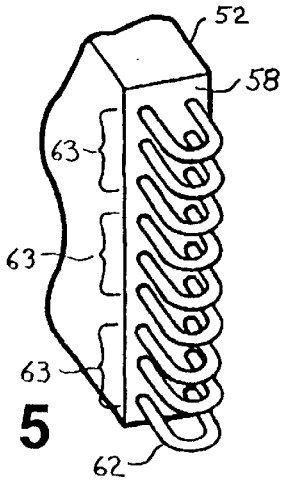
FIG. 5 is a partial pictorial view of the far end of the embodiment of FIG. 4, showing the arrangement of the lines extending beyond an end of the chamber.

Referring to FIGS. 4 and 5, an additional embodiment has a heat exchanger generally designated 50. The heat exchanger has a shell 52, preferably in the general shape of a parallelepiped having two large surfaces, separated by narrow walls. A plurality of channels 54, preferably made from straight segments of ⅜" diameter stainless steel tubing, pass through the shell and extend slightly beyond the front wall 56 and the rear wall 58 through holes defined in the end walls. The short extensions of channels beyond the walls are also referred to as nipples 60. The channels are preferably assembled in the shell in a plurality of horizontal rows, each row having a pair of channels, or more, aligned vertically with the next adjacent row. (As used herein the terms "horizontal," "horizontally," "vertical" and "vertically" are arbitrarily chosen directional references with "vertical" and "vertically" referring to the general vertical gravitational direction and "horizontal" and "horizontally" referring to the direction in a plane generally parallel with the surface of the floor of an enclosing building or the surface of the earth at that location.) The gap between adjacent channels in each row is preferably the same as the gap between vertically adjacent rows. This permits use of uniform U-shaped couplers 62, preferably made from stainless steel tubing, to connect adjacent nipples 60 whether vertical or horizontal, either in a row or between rows. Connections are preferably by silver soldering, or some other suitable method of connection such as Tungsten-Inert Gas (TIG) welding. Preferably the couplers have the same diameter as the channels to prevent anomalies which could disrupt the smooth flow of beer and contribute to its tendency to foam.

Illustrated in FIGS. 4 and 5, is an exemplary coupler arrangement which creates three separate channel networks each of which consists of six serial passes through the heat exchanger 50 for three respective beer lines (not shown). Arrow 64 indicates beer from a beer line entering a first channel 54 and at its opposite end (protruding from shell wall 58) the first channel is coupled horizontally to a second channel. The opposite end of the second channel (protruding from shell wall 56) is coupled vertically to a third channel in the next lower row which in turn is horizontally coupled at its opposite end (protruding from shell wall 58) to a fourth channel, and so on until the beer leaves the six-pass channel network as indicated by arrow 66. As can be seen the three six-pass networks are created by three intra-row couplings 63 at shell end 58, and two selective inter-row couplings at shell end 56. By using a channel network having six passes the coolant, a shell need only be approximately six and two-thirds feet long in order for the network to hold a full pint of beer, assuming a channel diameter of ⅜". Moreover, a 40" high shell can accommodate twenty-seven rows of channels 54, the rows preferably spaced 1.375 inches apart. This is enough for nine six-pass channel networks 63, each having three rows, or six passes through the shell. This means that a heat exchanger which is small enough to be located beneath a bar, next to or below the taps, can accommodate and be chilling nine different pints of beer at any given time.

This external coupling arrangement also permits easier maintenance and versatility of the heat exchanger. Since the couplers 62 are affixed to the nipples outside of the shell, any leaks would occur outside the shell where they can be repaired much easier. Also, by affixing the couplers 62 to the nipples outside the shell, changes can easily be made to the configuration of each channel. The number of passes through the shell can be changed simply by rearranging the couplers.

Referring to FIG. 4, the shell 52 preferably has a drain 68, communicating with the interior of the shell, located near a bottom edge and controlled by a drain valve 70 for draining coolant. The shell also preferably has a vent 72, communicating with the upper interior volume of the shell, controlled by a vent valve 74 to allow the shell to be vented. In operation, the temperature of the coolant in the heat exchanger will be greater than the desired 30° F. temperature when the system is first started. The temperature sensor 18 will detect the temperature of the coolant in the shell 52 and electrically communicate the temperature to the temperature controller 16 by sensor line 38. The temperature controller will compare the sensed temperature from the temperature sensor with an upper limit temperature entered into the temperature controller by an operator. When not energized by the temperature controller, valves 20 and 22 are in their normal positions, with valve 20 closed and valve 22 open, allowing coolant from the chiller (not shown) to flow through valve 22 in the direction of bypass arrow 88 and coolant return arrow 84, bypassing the heat exchanger 50. When the temperature controller detects a coolant temperature in the shell above the preset upper limit, it signals valve 20 to open and valve 22 to close. This is done by communicating the operating signals by control lines 44 and 46 to valves 20 and 22 respectively. Opening valve 20 and closing valve 22 allows coolant to be pumped from the chiller (not shown) to flow into the shell 52 of the heat exchanger, preferably through a plurality of coolant input lines 76, in the direction of coolant input arrows 78. The coolant will exit the shell of the heat exchanger, preferably through a plurality of exit lines 80 which join with a common exit line 81, the coolant exiting in the direction of coolant exit arrows 82. The coolant passes through open valve 20 and will return to the chiller by the coolant return line 83 in the direction of coolant return arrow 84. As previously described, the chiller cools the glycol coolant to a range, typically between approximately 23° F. and 28° F. This chilled coolant will flow through the shell 52, circulating around the tubing 54 making up the channels, cooling the beer in these channels. The coolant will exit the heat exchanger and return to the chiller as shown by coolant exit arrows 82 and coolant return arrows 84. As the temperature of the coolant in the shell lowers, it will be sensed by the temperature sensor 18. The temperature controller 16 will monitor the temperature sensor by sensor line 38 and when the temperature of the coolant reaches the lower limit of the desired temperature range set in the controller, preferably 29° F., the controller will cause the coolant to bypass the heat exchanger. It will signal valve 20 to close, by control line 44, and will signal valve 22 to open, by control line 46. This will cause the chilled coolant to be blocked by now closed valve 20, causing the coolant to flow in bypass line 86 in the direction of bypass arrow 88, through opened valve 22, returning to the chiller in bypass line 83, as shown by coolant return arrow 84. The coolant in the heat exchanger will keep the beer in the channels within the desired temperature range. As the coolant absorbs heat, either from outside the shell or from beer flowing through the channels in the shell, its temperature will rise. This rise in temperature will be detected by the sensor 18 causing the temperature controller 16 to again energize valves 20 and 22 to allow the chilled coolant to flow through the shell. This keeps the temperature of the coolant in the shell at, or very near, the preferred 30° F. temperature. The chilled beer flowing through a channel 63 in the heat exchanger 50 exits in direction of arrow 66 and continues through a connected beer line (not shown) to its connected tap 6 (See FIG. 1) for dispensing the chilled beer to a customer. The beer lines from the heat exchanger to the taps would preferably be insulated by an insulation sleeve 14 (See FIG. 1), either individually, or as grouped beer lines. If the beer lines are grouped for insulation in a single sleeve to the serving area, each individual beer line to a tap would also be preferably insulated by an insulation sleeve to its connected tap 6 (See FIG. 1).

Figure 6:
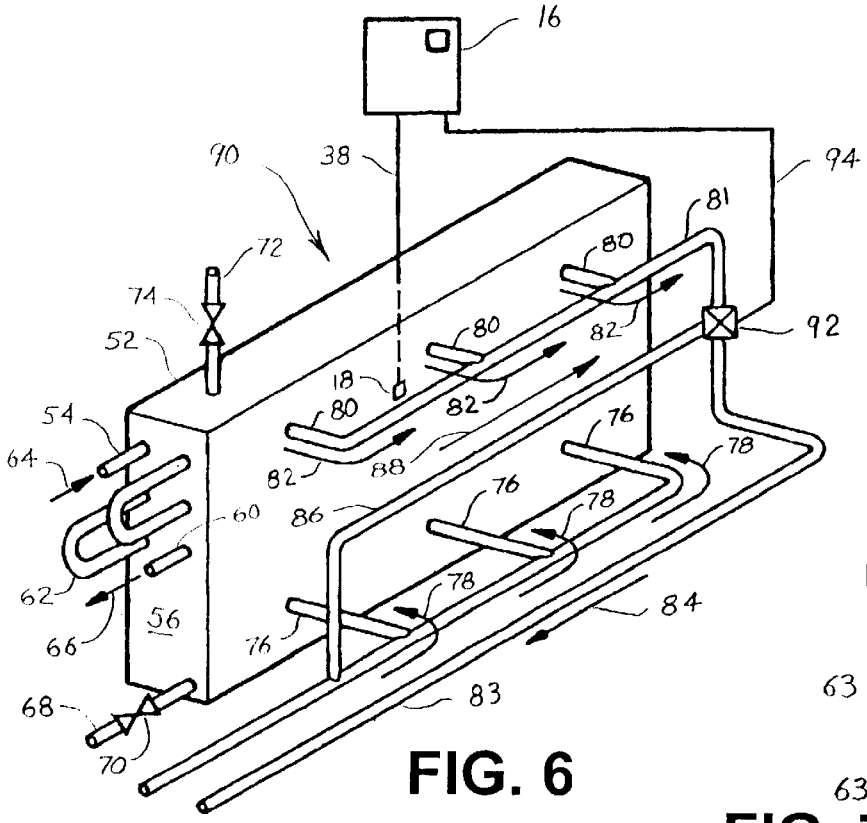
FIG. 6 is a partial pictorial view of an additional embodiment of this invention.
Figure 7:
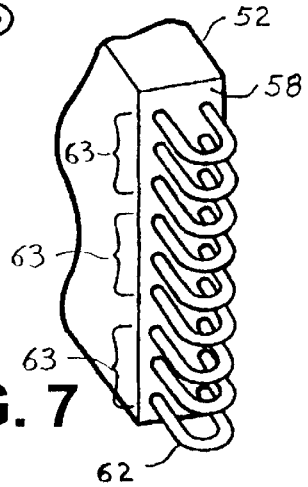
FIG. 7 is a partial pictorial view of the far end of the embodiment of FIG. 6.

Referring to FIGS. 6 and 7, an additional embodiment of the multichannel local beverage cooler of the invention has a heat exchanger generally designated 90. In this embodiment, the heat exchanger is the same as heat exchanger 50 (See FIGS. 4 and 5), except valves 20 and 22 and control lines 44 and 46 have been replaced by a solenoid operated three-way valve 92 and control line 94. The only valve in the coolant lines is the three-way valve 92 which is installed at the intersection of common exit line 81, return line 83 and bypass line 86. When the temperature sensor 18 detects a temperature above the desired upper limit set by an operator into the temperature controller 16 it will energize three-way valve 92 to change position by communication over control line 94. When energized, valve 92 will block the flow of coolant in bypass line 86, but will allow coolant to flow through the valve from the common exit line 81 to the return line 83 in the direction of coolant exit arrows 82 and coolant return arrows 84. This lets the chilled coolant flow into the shell 52 through coolant input lines 76 in the direction of coolant input arrows 78. The chilled coolant circulates past the channels 63 in the shell, cooling the beer contained in the channels. The coolant returns to the chiller through coolant exit lines 80, through valve 92 and coolant return line 83 in the direction of arrows 82 and 84. When the temperature of the coolant in the shell reaches the lower limit of the desired temperature range, as sensed by the temperature sensor 18, the temperature controller will de-energize three-way valve 92 by communicating with the valve over control line 94. This causes the valve to shut off the flow of coolant from the common exit line 81 and open the flow of coolant through the bypass line 86, allowing the coolant to flow through the bypass line, the valve, and back to the chiller through coolant return line 83.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. An apparatus for communicating a set of pressurized beverages from respective beverage reservoirs to respective outlets, and chilling the beverage(s) as they are being so communicated, the apparatus comprising:

(a) a liquid coolant container;

(b) liquid coolant disposed within the container;

(c) a chiller for pumpingly circulating refrigerated coolant through the container to maintain the coolant within the container at a selected temperature;

(d) a set of channels, one for each beverage, extending through the container and continuously bathed in the liquid coolant, each channel including a beverage ingress and a beverage egress;

(e) a set of lines, one for each beverage, for communicating said each beverage from its reservoir to the ingress of the beverage's corresponding channel, and (f) a set of lines, one for each beverage, for communicating said each beverage from the egress of its corresponding channel to its corresponding outlet.

2. The apparatus according to claim 1 further comprising a channel having multiple serial extensions through the container.

3. The apparatus according to claim 2 wherein the number of serial extensions of the channel through the container is selectable.

4. The apparatus according to claim 1 further comprising a channel having multiple parallel extensions through the container.

5. The apparatus according to claim 1 further comprising:

(a) at least two channels extending through the container, each channel having an end projecting from a common face of the container; and (b) a coupler for selectively coupling the ends to serialize the channels with respect to communication of beer.

6. The apparatus according to claim 1 wherein the chiller further comprises:

(a) a source conduit communicating pumped coolant from the chiller to the container, and (b) a return conduit communicating coolant from the container to the chiller.

7. The apparatus according to claim 6 further comprising:

(a) a bypass for communicating coolant from the source conduit to the return conduit without the container; and (b) selectively actuated valve means for blocking the bypass when actuated and blocking circulation through the container when not actuated.

8. The apparatus according to claim 7 further comprising a temperature sensor and a control device which actuates the valve means responsive to a signal from the sensor indicating that the coolant temperature is within a pre-selected range.

9. The apparatus according to claim 7 wherein the valve means comprises a three-way valve disposed at a junction of the bypass and the return conduit.

10. An apparatus for communicating a plurality of pressurized beers from respective kegs to respective taps, and chilling the beers as they are being so communicated, the apparatus comprising:

(a) a liquid coolant container;

(b) liquid coolant disposed within the container;

(c) a chiller for keeping the coolant within the container at a selected temperature;

(d) a set of channels, one for each keg, extending through the container and continuously bathed in the liquid coolant, each channel including a beer ingress and a beer egress;

(e) a set of lines, one for each keg, for communicating beer from said each keg to the ingress of the keg's corresponding channel, and (f) a set of lines, one for each channel, for communicating beer from said each channel egress to a corresponding tap.

11. The apparatus according to claim 10 wherein the chiller further comprises:

(a) a source conduit communicating pumped coolant from the chiller to the container, and (b) a return conduit communicating coolant from the container to the chiller.

12. The apparatus according to claim 10 further comprising:

(a) a bypass for communicating coolant from the source conduit to the return conduit without the container; and (b) selectively actuated valve means for blocking the bypass when actuated and blocking circulation through the container when not actuated.

13. The apparatus according to claim 12 further comprising a temperature sensor and a control device which actuates the valve means responsive to a signal from the sensor indicating that the coolant temperature is within a pre-selected range.

14. The apparatus according to claim 12 wherein the valve means comprises a three-way valve disposed at a junction of the bypass and the return conduit.

15. An apparatus for communicating a set of pressurized beers from respective kegs to respective taps, and chilling the beer(s) as they are being so communicated, the apparatus comprising:

(a) a liquid coolant container;

(b) liquid coolant disposed within the container;

(c) a chiller for keeping the coolant within the container at a selected temperature;

(d) a set of channels, one for each keg, extending through the container and continuously bathed in the liquid coolant, each channel including a beer ingress and a beer egress;

(e) a set of lines, one for each keg, for communicating beer from said each keg to the ingress of the keg's corresponding channel;

(f) a set of lines, one for each channel, for communicating beer from said each channel egress to a corresponding tap;

(g) a source conduit communicating pumped coolant from the chiller to the container;

(h) a return conduit communicating coolant from the container to the chiller;

(i) a bypass for communicating coolant from the source conduit to the return conduit without the container; and (j) selectively actuated valve means for blocking the bypass when actuated and blocking circulation through the container when not actuated.

16. The apparatus according to claim 15 further comprising a temperature sensor and a control device which actuates the valve means responsive to a signal from the sensor indicating that the coolant temperature is within a preselected range.

17. The apparatus according to claim 15 wherein the valve means comprises a three-way valve disposed at a junction of the bypass and the return conduit.

* * * * *